US006942008B1

(12) United States Patent
Jacobsen et al.

(10) Patent No.: US 6,942,008 B1
(45) Date of Patent: Sep. 13, 2005

(54) APPARATUS FOR PRODUCING CASTING MOULD PARTS

(75) Inventors: Ole Anders Jacobsen, Tisvildeleje (DK); Vagn Mogensen, Gentofte (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 10/239,402

(22) PCT Filed: Mar. 31, 2000

(86) PCT No.: PCT/DK00/00161

§ 371 (c)(1),
(2), (4) Date: Sep. 23, 2002

(87) PCT Pub. No.: WO01/74515

PCT Pub. Date: Oct. 11, 2001

(51) Int. Cl.[7] ..... B22C 15/08
(52) U.S. Cl. ..... 164/187; 164/169; 164/207
(58) Field of Search ..... 164/38, 169, 187, 164/195, 207, 213

(56) References Cited

U.S. PATENT DOCUMENTS 793,860 A * 7/1905 Tscherning ..... 164/207
4,437,507 A * 3/1984 Seeley ..... 164/173
4,442,882 A * 4/1984 Achinger et al. ..... 164/187
4,721,148 A * 1/1988 Knudsen ..... 164/187

* cited by examiner

*Primary Examiner*—Kiley S. Stoner
*Assistant Examiner*—Len Tran
(74) *Attorney, Agent, or Firm*—Stites & Harbison PLLC; Douglas E. Jackson

(57) ABSTRACT

The present invention provides an apparatus for producing casting mould parts by compacting mould material between a first squeeze plate and a second squeeze plate forming movable end walls of a moulding chamber, which subsequent to the compacting can be opened by moving the second squeeze plate out of the way, after which the mould part can be pushed out of the moulding chamber by a further movement of the first squeeze plate in its compacting direction, the movement of the first squeeze plate being provided by a hydraulic drive unit comprising a movable cylinder member connected to the first squeeze plate and an associated stationary piston member having a piston rod extending tightly through an inner wall of the cylinder member and a piston. The movable cylinder member is guided in its linear movement by the piston and by the piston rod. By further providing supplementary means for guiding the movable cylinder member, it is possible to reduce the sag of the piston rod and cylinder member, when the cylinder member is advanced to the full extent to push out the produced mould part and improve the rigidity of the first squeeze plate against tilting movement during compacting.

14 Claims, 1 Drawing Sheet

APPARATUS FOR PRODUCING CASTING MOULD PARTS

TECHNICAL FIELD

The present invention relates to an apparatus for producing casting mould parts by compacting mould material between a first squeeze plate and a second squeeze plate forming movable end walls of a moulding chamber, which subsequent to the compacting can be opened by moving the second squeeze plate out of the way, after which the mould part can be pushed out of the moulding chamber by a further movement of the first squeeze plate in the compacting direction thereof.

In apparatuses for producing casting mould parts of this kind, it is known to have the first squeeze plate guided by the piston, the piston rod and the cylinder member, the latter directly connected to the first squeeze plate. An apparatus of this kind is e.g. known from EP-020,082. In order to improve the guidance of the first squeeze plate, it is also known to provide the squeeze plate with wear plates along the edges, said wear plates engaging the surfaces of the moulding chamber during the compacting step, thereby reducing the possibilities of a transverse movement of the patterns and a consequent shift between the produced mould parts. However, this will not prevent a certain sag of the piston rod and cylinder member when the cylinder member is advanced to the full extent to push out the produced mould part, such sag potentially leading to tear off at the produced mould part surface in engagement with the squeeze plate or a pattern plate mounted thereon. Furthermore, the wear plates are not able to prevent a tilting movement of the squeeze plate when using an unsymmetrical pattern and the wear plates cause a substantial continuous wear, not only on the wear plates, but also on the surfaces of the chamber in engagement therewith. Furthermore, the chamber will normally be provided with a certain draft in order to facilitate the pushing out of the produced mould and accordingly, the fitting tolerances between wear plates and chamber wall will be dependent on the position of the squeeze plate and not necessarily at an optimum during the compacting. Differences in temperature and in thermal expansion coefficient for the different components may further influence the above fitting tolerances.

DISCLOSURE OF THE INVENTION

It is an object of the present invention to provide an apparatus of the kind referred to above, with which it is possible to reduce the sag of the piston rod and cylinder member and possibly avoiding the use of at least some of the wear plates along the edges of the squeeze plate, and this object is achieved with an apparatus of said kind which according to the present invention also comprises a supplementary means for guiding the cylinder member. With this arrangement, the cylinder member is supported, not only by the piston and piston rod, but also by the supplementary guiding means, supporting and guiding the cylinder member directly and possibly supporting the piston and piston rod indirectly via said cylinder member. Preferred embodiments of the invention are revealed and the advantages thereof are revealed in the following detailed description.

BRIEF DESCRIPTION OF THE DRAWINGS

In the following detailed part of the present description, the invention will be explained in more detail with reference to the exemplary embodiments of an apparatus for producing casting mould parts according to the invention shown in the drawings, in which FIG. 1 schematically shows parts of an apparatus in accordance with the invention, in which the supplementary means for guiding the cylinder member is provided in the form of a bearing located close to the position of the piston and provided in the back wall of the moulding chamber, and co-operating with the outer cylindrical surface of the cylinder member, FIG. 2 schematically shows an alternative supplementary means for guiding the cylinder member in the form of rollers mounted on the cylinder and rolling on corresponding linear roller supporting surfaces, and FIG. 3 schematically shows yet another alternative supplementary means for guiding the cylinder member in the form of an annular bearing surface fixed to the cylinder member at one end thereof and co-operating with a tubular bearing surface provided around the cylinder member.

DESCRIPTION OF THE PREFERRED EMBODIMENTS

Figure 1:
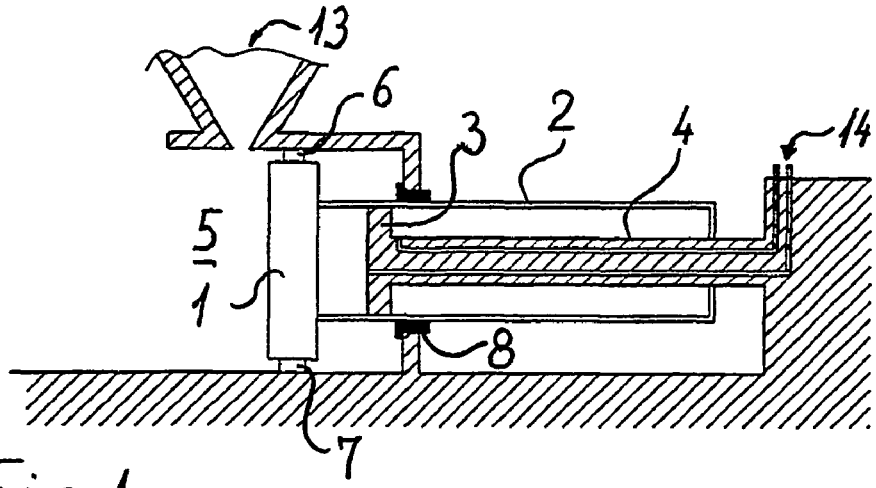
Figure 2:
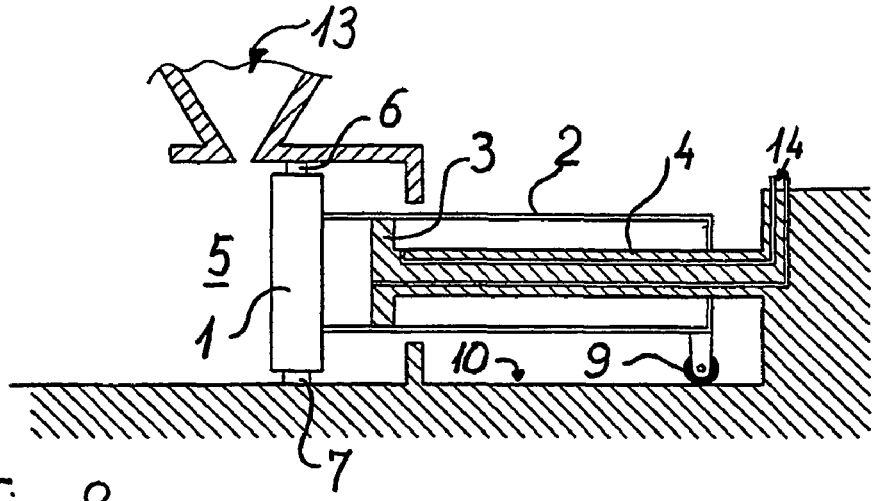
Figure 3:
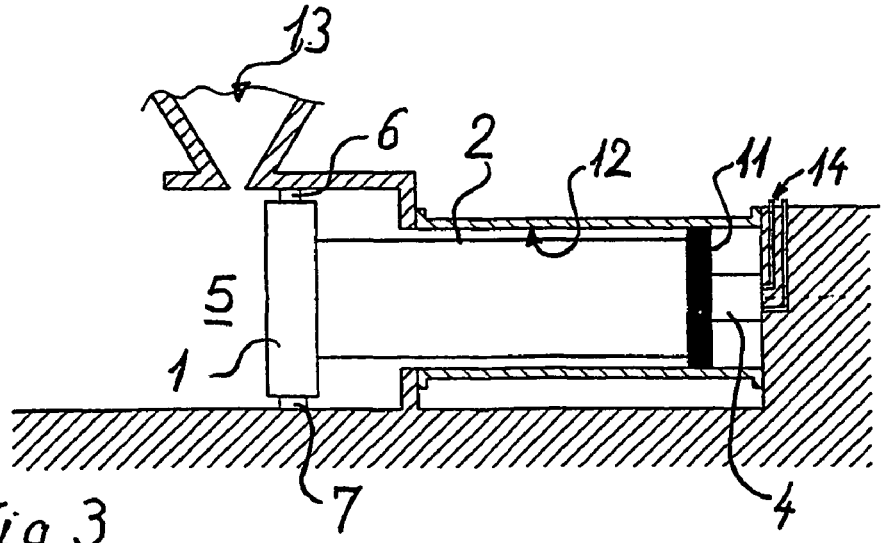

The apparatus schematically and partly shown in FIGS. 1–3 comprises a first squeeze plate 1 mounted directly on a cylinder member 2 for linear movement of the first squeeze plate 1 inside the moulding chamber 5 and out of this moulding chamber to the left as seen in FIGS. 1–3. In use, the first squeeze plate 1 will be provided with a first pattern (not shown) for forming one part of a moulding cavity in the produced mould part, and a second squeeze plate (not shown) will be provided with a second pattern for forming another part of the moulding cavity in the produced mould part. Furthermore, the Figures schematically show a mould material hopper 13 provided on top of the moulding chamber for filling the moulding chamber with mould material. As also shown in all of the Figures, the first squeeze plate 1 may be provided with wear plates 6, 7, positioned along the edges of the first squeeze plate 1 in order to improve the guidance of the first squeeze plate 1 during its movement inside the moulding chamber 5, the wear plates 7 at the bottom also guiding the movement of the first squeeze plate 1 when it is outside the moulding chamber 5.

Hydraulic fluid for moving the cylinder member 2 is supplied and discharged through hydraulic connections 14 through the piston rod 4 connected to a fixed part of the apparatus.

In the embodiment shown in FIG. 1 in the back wall of the moulding chamber a bearing is provided co-operating with the outer surface of the cylinder member 2. This bearing provides a guidance of the cylinder member 2 and indirectly the piston 3, whereby the first squeeze plate 1 is intimately guided during the squeezing of the produced mould part. In this way it is possible to guide the first squeeze plate sufficiently to avoid the use of the wear plates 6 at the top and sides of the first squeeze plate 1, whereas the wear plate 7 at the bottom of the first squeeze plate 1 is preferably used in order to prevent the sag of the cylinder member when the cylinder member is advanced to the full extent to push out the produced mould part. As can be seen, the bearing 8 in the moulding chamber back wall prevents the piston and piston rod from moving both up and down and sideways, thereby preventing the sag of the piston rod and piston when the cylinder member is advanced to the full extent and providing an improved rigidity against the above-mentioned tilting movement of the first squeeze plate 1.

In the embodiments shown in FIGS. 2 and 3, the supplementary means for guiding the movable cylinder member 2 are provided at the inner end wall of the cylinder member 2, whereby the guidance of the first squeeze plate 1 is less efficient compared to the embodiment shown in FIG. 1, but still provides a reduction of the sag of the piston rod and cylinder member when the cylinder member is advanced to the full extent to push out the produced mould part. In both of these embodiments, it is recommended to use wear plates 6, 7 along the edges of the first squeeze plate 1, in order to improve the guidance of the first squeeze plate 1 during compacting.

In the embodiment shown in FIG. 2, the supplementary means for guiding the movable cylinder member is provided in the form of guiding rollers 9 co-operating with corresponding rolling surfaces 10 provided on fixed parts of the apparatus. When the cylinder member 2 is advanced to the full extent, the guiding rollers 9 will support the cylinder member 2 and the piston rod 4 and the piston 3, thereby reducing the sag of the piston rod and cylinder member.

In the embodiment shown in FIG. 3, the supplementary means for guiding the cylinder member 2 is provided in the form of a bearing 11 at the back of the cylinder member 2, said bearing co-operating with a bearing surface 12 surrounding the cylinder member 2. The function of the bearing 11 and the bearing surface 12 corresponds to the function of the guiding rollers 9 and rolling surfaces 10 described above.

Although the invention above has been described in connection with specific embodiments thereof, shown in the drawing, it will be evident for a man skilled in the art that other possibilities for providing supplementary means for guiding the movable cylinder member 2 may be envisaged, among such possibilities are the provision of the bearing 11 and bearing surface 12 in the form of bearing surfaces with a polygonal cross-section and possibly combinations of the different embodiments shown in FIGS. 1–3.

What is claimed is:

1. Apparatus for producing casting mould parts by compacting mould material between a first squeeze plate and a second squeeze plate forming movable end walls of a moulding chamber, which subsequent to the compacting can be opened by moving the second squeeze plate out of the way, after which the mould part can be pushed out of the moulding chamber by a further movement of the first squeeze plate in the compacting direction thereof, said apparatus comprising:

a frame;

a hydraulic drive unit which provides the movement of the first squeeze plate, said drive unit comprising a movable cylinder member connected to the first squeeze plate and an associated stationary piston member having (a) a piston rod including a distal end and a connection between said distal end and said frame which said connection is rigid and which inherently prevents movement between said distal end and said frame regardless of any other restraint of said piston rod, said piston rod also extending tightly through an inner end wall of the cylinder member and (b) a piston dividing the chamber of said cylinder member into an outer end chamber and an inner, annular compartment surrounding a piston rod, whereby said movable cylinder member is guided in a linear movement thereof by the piston and by the piston rod, both compartments being provided with inlet and outlet connections for supply and discharge of a pressure fluid, a supplementary means for guiding the movable cylinder member, and wear plates mounted at a bottom of the first squeeze plate.

2. Apparatus in accordance with claim 1, wherein the supplementary means for guiding the movable cylinder member is a bearing close to the position of the piston and co-operating with the outer cylindrical wall of the movable cylinder member.

3. Apparatus in accordance with claim 1, wherein the supplementary means for guiding the movable cylinder member is a number of rollers connected to the movable cylinder member at the inner end wall thereof, said rollers co-operating with corresponding linear roller-supporting surfaces provided on the frame.

4. Apparatus in accordance with claim 1, wherein the supplementary means for guiding the movable cylinder member is a bearing surface fixed at the inner end wall of the movable cylinder member and a surface co-operating therewith.

5. Apparatus in accordance with claim 2, wherein the bearing is located in a back wall of the moulding chamber.

6. Apparatus in accordance with claim 4, wherein the co-operating surface is a linear bearing surface surrounding the movable cylinder member.

7. Apparatus in accordance with claim 6, wherein said linear bearing surface is a circular cylindrical.

8. Apparatus in accordance with claim 6, wherein said linear bearing surface is polygonal.

9. Apparatus for producing casting mould parts by compacting mould material between a first squeeze plate and a second squeeze plate forming movable end walls of a moulding chamber, which subsequent to the compacting can be opened by moving the second squeeze plate out of the way, after which the mould part can be pushed out of the moulding chamber by a further movement of the first squeeze plate in the compacting direction thereof, said apparatus comprising:

a frame;

a hydraulic drive unit which provides the movement of the first squeeze plate, said drive unit comprising a movable cylinder member connected to the first squeeze plate and an associated stationary piston member having (a) a piston rod including a distal end and a connection between said distal end and said frame which said connection is rigid and which inherently prevents movement between said distal end and said frame regardless of any other restraint of said piston rod, said piston rod also extending tightly through an inner end wall of the cylinder member and (b) a piston dividing the chamber of said cylinder member into an outer end chamber and an inner, annular compartment surrounding a piston rod, whereby said movable cylinder member is guided in a linear movement thereof by the piston and by the piston rod, both compartments being provided with inlet and outlet connections for supply and discharge of a pressure fluid, and a supplementary means for guiding the movable cylinder member, wherein the supplementary means for guiding the movable cylinder member is a number of rollers connected to the movable cylinder member at the inner end wall thereof, said rollers co-operating with corresponding linear roller-supporting surfaces provided on the frame.

10. Apparatus for producing casting mould parts by compacting mould material between a first squeeze plate and a second squeeze plate forming movable end walls of a moulding chamber, which subsequent to the compacting can be opened by moving the second squeeze plate out of the way, after which the mould part can be pushed out of the moulding chamber by a further movement of the first squeeze plate in the compacting direction thereof, said apparatus comprising:

a frame;

a hydraulic drive unit which provides the movement of the first squeeze plate, said drive unit comprising a movable cylinder member connected to the first squeeze plate and an associated stationary piston member having (a) a piston rod including a distal end and a connection between said distal end and said frame which said connection is rigid and which inherently prevents movement between said distal end and said frame regardless of any other restraint of said piston rod, said piston rod also extending tightly through an inner end wall of the cylinder member and (b) a piston dividing the chamber of said cylinder member into an outer end chamber and an inner, annular compartment surrounding a piston rod, whereby said movable cylinder member is guided in a linear movement thereof by the piston and by the piston rod, both compartments being provided with inlet and outlet connections for supply and discharge of a pressure fluid, and a supplementary means for guiding the movable cylinder member, wherein the supplementary means for guiding the movable cylinder member is a bearing surface fixed at the inner end wall of the movable cylinder member and a surface co-operating therewith.

11. Apparatus in accordance with claim 10, further comprising wear plates mounted at a bottom of the first squeeze plate.

12. Apparatus in accordance with claim 10, wherein said linear bearing surface is a circular cylindrical.

13. Apparatus in accordance with claim 10, wherein the co-operating surface is a linear bearing surface surrounding the movable cylinder member.

14. Apparatus in accordance with claim 13, wherein said linear bearing surface is polygonal.

* * * * *